US010979819B2

(12) United States Patent
Xiao et al.

(10) Patent No.: US 10,979,819 B2
(45) Date of Patent: Apr. 13, 2021

(54) SOUND DEVICE

(71) Applicant: AAC Acoustic Technologies (Shenzhen) Co., Ltd., Shenzhen (CN)

(72) Inventors: Bo Xiao, Shenzhen (CN); Ronglin Linghu, Shenzhen (CN)

(73) Assignee: AAC Acoustic Technologies (Shenzhen) Co., Ltd., Shenzhen (CN)

( * ) Notice: Subject to any disclaimer, the term of this patent is extended or adjusted under 35 U.S.C. 154(b) by 0 days.

(21) Appl. No.: 16/695,110

(22) Filed: Nov. 25, 2019

(65) Prior Publication Data

US 2020/0186930 A1 Jun. 11, 2020

(30) Foreign Application Priority Data

Dec. 5, 2018 (CN) ..... 201822038825.9

(51) Int. Cl.

| | |
|---|---|
| ***H04R 25/00*** | (2006.01) |
| ***H04R 9/06*** | (2006.01) |
| ***H04R 7/12*** | (2006.01) |
| ***H04R 9/02*** | (2006.01) |
| ***H04R 7/18*** | (2006.01) |

(52) U.S. Cl.
CPC ..... *H04R 9/06* (2013.01); *H04R 7/12* (2013.01); *H04R 7/18* (2013.01); *H04R 9/025* (2013.01); *H04R 2400/11* (2013.01)

(58) Field of Classification Search
CPC ..... H04R 9/06; H04R 9/025; H04R 2400/11; H04R 2400/07; H04R 9/04
See application file for complete search history.

(56) References Cited

U.S. PATENT DOCUMENTS

| | | | | |
|---|---|---|---|---|
| 7,194,287 | B2 * | 3/2007 | Usuki | H04R 11/06 340/388.4 |
| 7,936,251 | B1 * | 5/2011 | Hamaguchi | B06B 1/0284 340/7.6 |
| 9,813,821 | B1 * | 11/2017 | Song | H04R 9/025 |
| 9,838,795 | B2 * | 12/2017 | Wang | H04R 9/06 |
| 10,003,887 | B2 * | 6/2018 | Linghu | H04R 9/04 |
| 10,250,989 | B1 * | 4/2019 | Xiao | H04R 31/003 |
| 10,284,959 | B2 * | 5/2019 | Xiao | H04R 9/06 |
| 10,820,107 | B2 * | 10/2020 | Feng | H04R 9/025 |
| 2009/0136065 | A1 * | 5/2009 | Yano | H04R 31/006 381/186 |
| 2014/0056464 | A1 * | 2/2014 | Li | H04R 9/025 381/400 |
| 2014/0056465 | A1 * | 2/2014 | Li | H04R 9/025 381/400 |
| 2016/0100254 | A1 * | 4/2016 | Bae | H04R 7/26 381/354 |
| 2020/0045434 | A1 * | 2/2020 | Zhou | H04R 7/122 |

* cited by examiner

*Primary Examiner* — Phylesha Dabney
(74) *Attorney, Agent, or Firm* — W&G Law Group LLP

(57) ABSTRACT

The present disclosure provides a sound device, which includes a magnetic circuit system, wherein the magnetic circuit system includes a bottom plate, a first magnetic portion arranged on the bottom plate and a second magnetic portion spaced apart from the first magnetic portion, at least one of the first magnetic portion and the second magnetic portion is a permanent magnet, the bottom plate is provided with a through hole penetrating through the bottom plate, the sound device further includes a damping member, the damping member is fixed on the bottom plate and completely covers the through hole, and the permanent magnet is at least partially abutted against the damping member.

10 Claims, 3 Drawing Sheets

SOUND DEVICE

TECHNICAL FIELD

The present disclosure relates to electroacoustic conversion technologies, and more particularly, to a sound device applied to a portable electronic product.

BACKGROUND

With an advent of a mobile Internet era, the number of intelligent mobile devices is increasing. Among numerous mobile devices, a mobile phone is undoubtedly the most common and portable mobile terminal device. At present, the mobile phone has extremely diverse functions, one of which is a high-quality music function. Therefore, a sound device for playing sound is widely used in current intelligent mobile devices.

An important factor affecting performance of the sound devices is a damping effect, so that various frictions and other blocking effects attenuating free vibration are called damping. A good application of damping can improve a frequency response characteristic and improve acoustic performance of the sound device.

The sound device in related technologies includes a basket, a vibration system fixed to the basket and a magnetic circuit system driving the vibration system to vibrate. The vibration system may compress air in an inner cavity of the sound device while vibrating. Therefore, an electroacoustic device is provided with a leakage hole, and a damping sheet is attached to the leakage hole and the damping sheet plays a role of dust prevention and sound resistance improvement. However, under a condition of a small external space, the structure is easy to cause blockage of the leakage hole, thus affecting the acoustic performance of products. And the damping sheet is arranged to cover the leakage hole, manual bonding procedures need to be added outside an automatic line during assembly, and in addition, there is a risk of failure and falling of the damping sheet in related environmental tests of finished products, which affects the product performance. Therefore, it is necessary to provide a new sound device to solve the technical problems above.

DETAILED DESCRIPTION

The present disclosure is further described hereinafter with reference to the drawings.

Figure 1:
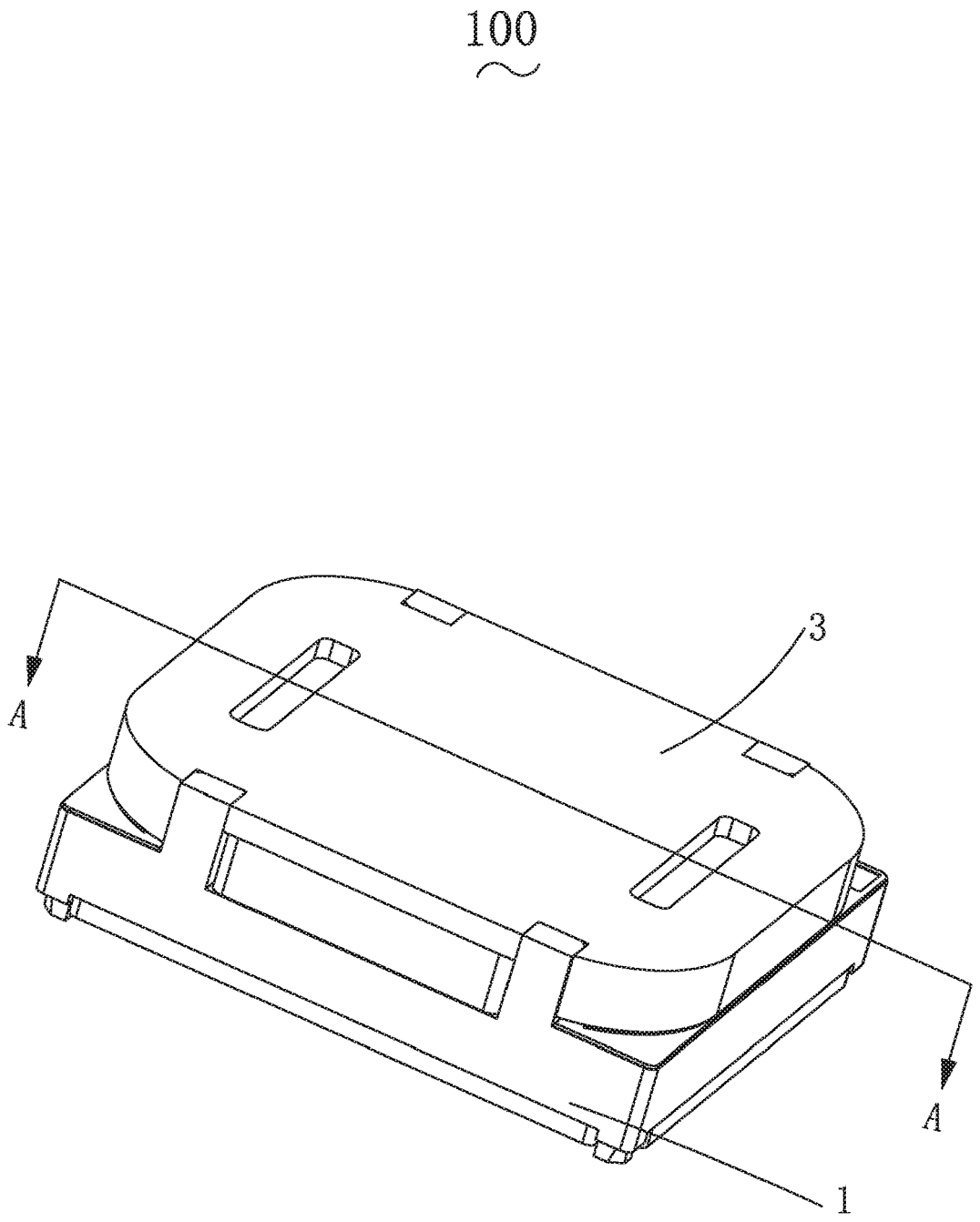
FIG. 1 is a perspective diagram of a sound device according to the present disclosure.
Figure 2:
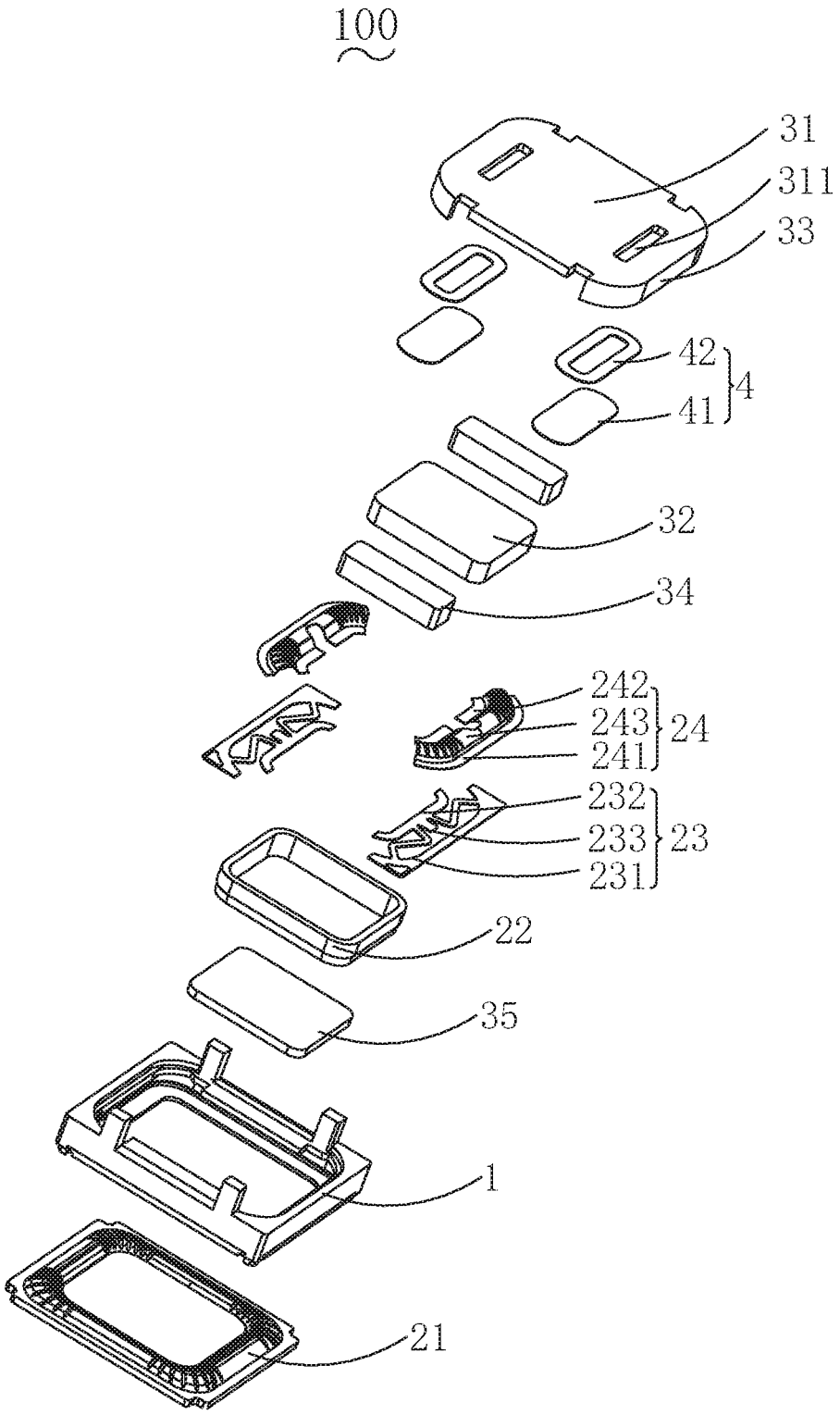
FIG. 2 is a partial enlarged perspective diagram of the sound device according to the present disclosure.
Figure 3:
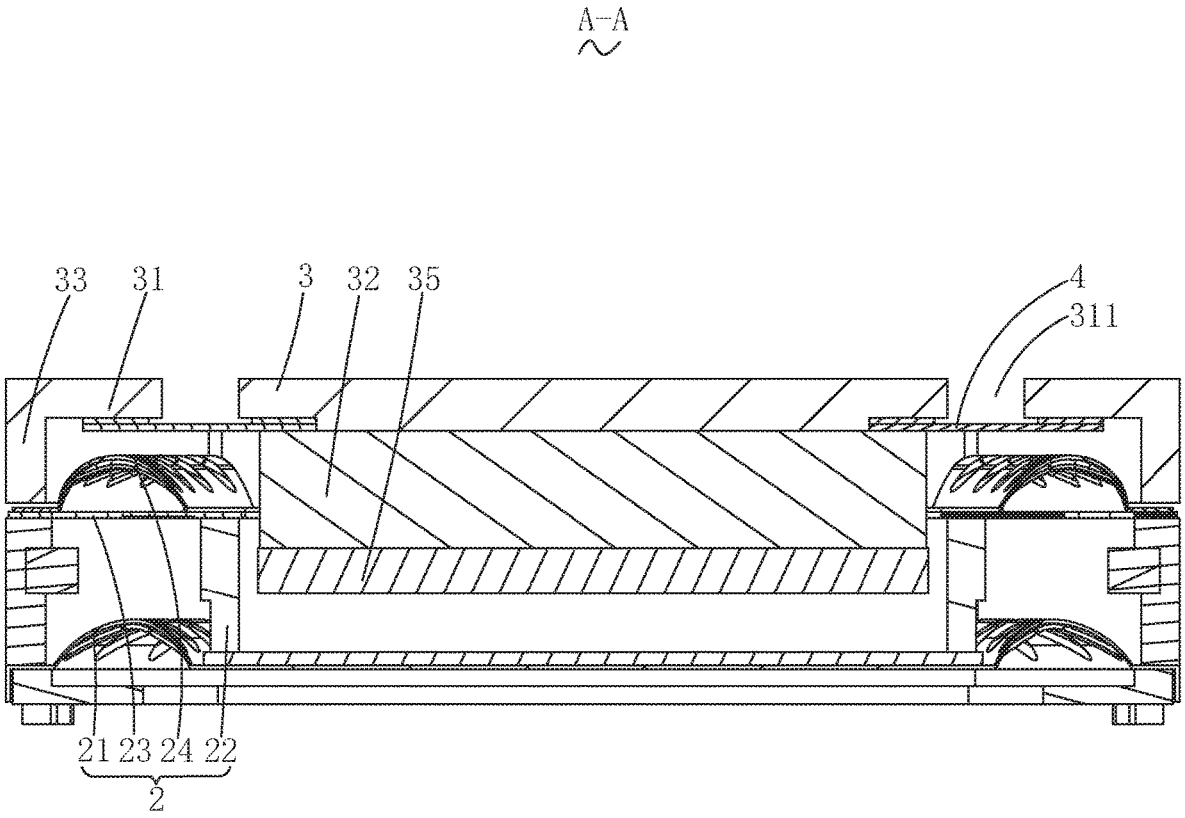
FIG. 3 is a sectional view along an A-A line in FIG. 1.

As shown in FIG. 1 to FIG. 3, the present disclosure provides a sound device 100, which includes a basket 1, a vibration system 2 and a magnetic circuit system 3 that are fixed to the basket 1, and a damping member 4.

The basket 1 is used for fixedly supporting the vibration system 2 and the magnetic circuit system 3. The basket 1 may be a circle or a rectangle, and in the embodiment, the basket 1 is illustrated as the rectangle.

The vibration system 2 includes a first diaphragm 21 fixed to the basket, a voice coil 22 driving the first diaphragm 21 to vibrate and sound, and a FPC 23 supporting and fixing the voice coil.

The FPC 23 includes a first fixing arm 231 and a second fixing arm 232 that are disposed separately from each other, and an elastic arm 233 connecting the first fixing arm 231 with the second fixing arm 232, the first fixing arm 231 is fixed to the basket 1, and the second fixing arm 232 is fixed to one end of the voice coil 22 away from the first diaphragm 21.

Preferably, two FPCs 23 are provided and are disposed separately from each other, and the two FPCs 23 are arranged around the magnetic circuit system 3.

Preferably, the voice coil 22 is electrically connected with the second fixing arm 232.

The first diaphragm 21 is used to vibrate and sound, and the voice coil 22 is fixed to the first diaphragm 21 and is suspended.

More preferably, the vibration system 2 further includes a second diaphragm 24 elastically supporting the voice coil 22.

The second diaphragm 24 is fixed to one end of the voice coil 22 away from the first diaphragm 21.

The FPC 23 supports and fixes the voice coil 22, for example, the voice coil 22 is fixed by the FPC 23 fixed to the second diaphragm 24.

In order to further enhance vibrating stability and reliability of the sound device 100, in this embodiment, two second diaphragms 24 are provided and disposed separately from each other, and are respectively fixed to two opposite ends of the same FPC 23, and of course, the number of the second diaphragms 24 is not limited to two. The two second diaphragms 24 are segmented and symmetrical, thus saving a space on one hand, and strengthening an anti-sway performance of the voice coil 22 and improving an acoustic performance and reliability of the sound device 100 on the other hand.

Specifically, the second diaphragm 24 includes an arc-shaped vibrating portion 243, and a first fixing portion 241 and a second fixing portion 242 that are respectively extending from two opposite sides of the vibrating portion 243, the first fixing portion 241 is fixed to the first fixing arm 231 of the FPC 23, the second fixing portion 242 is fixed to the second fixing arm 232 of the FPC 23, and the vibrating portion 243 is disposed separately from the elastic arm 233. That is, the second diaphragm 24 is fixed to the basket 1 through the FPC 23 and supports the voice coil 22.

On one hand, the structure above directly leads the voice coil 22 to an external power source by replacing a voice coil lead with the FPC 23, thus avoiding a problem of a low reliability of the sound device 100 caused by a risk of breakage of the voice coil lead and on the other hand, the second diaphragm 24 prevents the voice coil 22 from swaying caused by vibration and strengthens a vibrating performance of the vibration system 2, so that an acoustic performance such as a sound intensity of the sound device 100 is better, and the stability is better.

The magnetic circuit system 3 is used for driving the vibration system 2 to vibrate and sound. The basket 1, the vibration system 2 and the magnetic circuit system 3 define a rear cavity (not numbered) for improving a low-frequency acoustic performance of the sound device 100.

The magnetic circuit system 3 includes a bottom plate 31, a first magnetic portion 32 and a second magnetic portion 33 that are arranged on the bottom plate, and the second magnetic portion is disposed around the first magnetic portion. The structure enables a magnetic gap (not numbered) to be formed between the first magnetic portion 32 and the second magnetic portion 33, at least one of the first magnetic portion 32 and the second magnetic portion 33 is a permanent magnet, and the bottom plate 31 is provided with a through hole 311 penetrating through the bottom plate.

Preferably, two through holes 311 are provided and are symmetrical about a center of the bottom plate 31. The symmetrical structure enables sound pressure adjustment in the rear cavity to be more balanced. Of course, the number of the through holes 311 is not limited to two, and the through holes 311 are mainly used to balance a sound pressure of the rear cavity.

In the embodiment, the sound device 100 is a rectangle, the bottom plate 31 is a plate-like structure, the first magnetic portion 32 is located at a center of the bottom plate, and the two through holes 311 are arranged on two opposite sides of the first magnetic portion 32.

It should be noted that the sound device 100 is not limited to a rectangle, but may alternatively be a circle or other shapes, which are all feasible, and a principle of setting the through hole 311 is the same.

The damping member 4 is fixed to the bottom plate 31 and completely covers the through hole 311, and the permanent magnet at least partially abuts against the damping member 4.

The damping member 4 covers the through hole 311 for preventing external foreign particles from entering the rear cavity, so as to improve a reliability of the sound device 100. In addition, an air flow in the rear cavity is allowed to circulate with an external space, and damping of the rear cavity is changed through the damping member 4, thus improving low-frequency distortion and acoustic performance.

The bottom plate 31 is not limited to the plate-like structure, and a structure on which the magnetic portion can be placed can be referred to as a bottom plate. At least one of the first magnetic portion 32 and the second magnetic portion 33 is the permanent magnet, as in the embodiment of the present disclosure, the first magnetic portion 32 is the permanent magnet, and when the second magnetic portion 33 is integrally arranged with the bottom plate 31, the bottom plate 31 is a magnetic bowl-shaped structure with a side wall, and the first magnetic portion 32 and/or the second magnetic portion 33 at least partially abuts against the damping member 4.

Preferably, the through hole 311 is arranged between the first magnetic portion 32 and the second magnetic portion 33, and the first magnetic portion 32 and the second magnetic portion 33 abut against the damping member 4.

When both the first magnetic portion 32 and the second magnetic portion 33 are permanent magnets, the bottom plate 31 is a plate-like structure.

When the second magnetic portion 33 is the permanent magnet, and the first magnetic portion 32 is integrally arranged with the bottom plate 31, the bottom plate 31 is a T-shaped structure.

In this embodiment, the magnetic circuit system 3 further includes side magnetic steel 34 located around the second magnetic portion 33 and a lower clamp plate 35 opposite to the bottom plate 31.

Preferably, two through holes 311 are provided and symmetrical about a center of the bottom plate 31, and two damping members 4 are provided and symmetrical about the center of the bottom plate 31.

In this embodiment, the damping member 4 includes an air-permeable damping sheet 41 and a back adhesive 42 attached to one side of the air-permeable damping sheet 41 close to the bottom plate 31, and the back adhesive 42 fixes the air-permeable damping sheet 41 to the bottom plate 31 and enables the air-permeable damping sheet 41 to completely cover the through hole 311.

The damping member 4 is attached and fixed to one side of the bottom plate 31 close to the vibration system 2, and in addition, the permanent magnet is used to abut against a local area of the damping member 4. In this way, a leakage hole is not easy to be blocked, a bonding process of the damping member on an automatic magnetic circuit bonding line can be completed while a low-frequency performance of the sound device 100 is ensured, a risk of failure and falling of the damping member in an environmental test is further helpful to be reduced, and efficiency is beneficial to be improved and a cost is beneficial to be reduced compared with the current structure.

Compared with related technologies, the magnetic circuit system of the sound device in the present disclosure includes the bottom plate, the first magnetic portion and the second magnetic portion that are arranged on the bottom plate, and the second magnetic portion is disposed around the first magnetic portion. At least one of the first magnetic portion and the second magnetic portion is the permanent magnet, the bottom plate is provided with the through hole penetrating through the bottom plate and arranged between the first magnetic portion and the second magnetic portion. The sound device further includes the damping member, the damping member is fixed to the bottom plate and completely covers the through hole, and the permanent magnet at least partially abuts against the damping member. The damping member is placed and covered on the through hole, and in addition the permanent magnet is used to abut against a local area of the damping member, In this way, a leakage hole is not easy to blocked, and not only a bonding process of the damping member on an automatic magnetic circuit bonding line can be completed, but also a risk of failure and falling of the damping member in an environmental test is helpful to be reduced. The structure in the present disclosure is beneficial for improving the efficiency and reducing the cost compared with the current structure.

The description above is merely embodiments of the present disclosure, and it should be pointed out that, those of ordinary skills in the art can make improvements without departing from the inventive concept of the present disclosure, but these all belong to the scope of protection of the present disclosure.

What is claimed is:

1. A sound device, comprising a magnetic circuit system, wherein the magnetic circuit system comprises a bottom plate, a first magnetic portion and a second magnetic portion that are arranged on the bottom plate, the second magnetic portion is disposed around the first magnetic portion, at least one of the first magnetic portion and the second magnetic portion is a permanent magnet, wherein the bottom plate is provided with a through hole penetrating through the bottom plate, the sound device further comprises a damping member, the damping member is fixed on the bottom plate and completely covers the through hole, and the permanent magnet at least partially abuts against the damping member.

2. The sound device according to claim 1, wherein the first magnetic portion is the permanent magnet, and the second magnetic portion is integrally arranged with the bottom plate.

3. The sound device according to claim 1, wherein the second magnetic portion is the permanent magnet, and the first magnetic portion is integrally arranged with the bottom plate.

4. The sound device according to claim 1, wherein both the first magnetic portion and the second magnetic portion are permanent magnets, and the first magnetic portion and/or the second magnetic portion at least partially abuts against the damping member.

5. The sound device according to claim 4, wherein the through hole is arranged between the first magnetic portion and the second magnetic portion, and the first magnetic portion and the second magnetic portion abuts against the damping member.

6. The sound device according to claim 1, wherein two through holes are provided and are symmetrical about a center of the bottom plate.

7. The sound device according to claim 1, further comprising a basket and a vibration system fixed to the basket, wherein the vibration system comprises a first diaphragm fixed to the basket, a voice coil driving the first diaphragm to vibrate and sound, and a FPC supporting and fixing the voice coil.

8. The sound device according to claim 7, wherein the FPC comprises a first fixing arm and a second fixing arm disposed separately from each other, and an elastic arm connecting the first fixing arm with the second fixing arm, the first fixing arm is fixed to the basket, and the second fixing arm is fixed to one end of the voice coil away from the first diaphragm.

9. The sound device according to claim 8, wherein the vibration system further comprises a second diaphragm elastically supporting the voice coil, the second diaphragm comprises an arc-shaped vibrating portion, and a first fixing portion and a second fixing portion that are respectively extending from two opposite sides of the vibrating portion, the first fixing portion is fixed to the first fixing arm, the second fixing portion is fixed to the second fixing arm, and the vibrating portion is disposed separately from the elastic arm.

10. The sound device according to claim 7, wherein two FPCs are provided and are disposed separately from each other, and the two FPCs are arranged around the magnetic circuit system.

* * * * *